US008287091B2

(12) United States Patent
Kyoshima et al.

(10) Patent No.: US 8,287,091 B2
(45) Date of Patent: Oct. 16, 2012

(54) INKJET PRINTING APPARATUS AND INKJET PRINTING METHOD

(75) Inventors: Masayuki Kyoshima, Tokyo (JP); Masaki Oikawa, Inagi (JP); Keiji Tomizawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 256 days.

(21) Appl. No.: 12/816,732

(22) Filed: Jun. 16, 2010

(65) Prior Publication Data

US 2010/0328384 A1 Dec. 30, 2010

(30) Foreign Application Priority Data

Jun. 24, 2009 (JP) ..... 2009-150075

(51) Int. Cl.
*B41J 2/145* (2006.01)
*B41J 2/15* (2006.01)

(52) U.S. Cl. ..... 347/41

(58) Field of Classification Search ..... 347/41
See application file for complete search history.

(56) References Cited

U.S. PATENT DOCUMENTS

| | | | |
|---|---|---|---|
| 6,164,773 | A | 12/2000 | Oikawa |
| 6,648,439 | B2 | 11/2003 | Oikawa |
| 7,556,330 | B2 | 7/2009 | Saito et al. |
| 7,695,088 | B2 | 4/2010 | Yamane et al. |
| 2007/0216724 | A1 | 9/2007 | Shibata et al. |

FOREIGN PATENT DOCUMENTS

| | | | |
|---|---|---|---|
| JP | 2006-192892 | A | 7/2006 |

*Primary Examiner* — Julian Huffman
(74) *Attorney, Agent, or Firm* — Fitzpatrick, Cella, Harper & Scinto

(57) ABSTRACT

An inkjet printing apparatus and an inkjet printing method are provided which can minimize air current disturbances that occur between the print head and the print medium and also minimize density unevenness caused by mask patterns. For this purpose, the 2-pass printing is performed such that the high printing ratio region and the low printing ratio region are alternated every pixel in the nozzle-arrayed direction and that adjoining groups of high printing ratio regions are separated from one another by a group of low printing ratio regions that forms a passage wide enough for air currents to pass through.

6 Claims, 10 Drawing Sheets

INKJET PRINTING APPARATUS AND INKJET PRINTING METHOD

BACKGROUND OF THE INVENTION

1. Field of the Invention

The present invention relates to an inkjet printing method and an inkjet printing apparatus which print images on a print medium by using an inkjet print head formed with nozzle arrays, each having ink ejecting nozzles arranged at high density.

2. Description of the Related Art

As information processing devices, such as computers and word processors, and communication devices have come into wide use, there are growing demands for output devices that output digital image information processed by the information processing devices onto a medium. As one such output device, an inkjet printing apparatus that forms an image by ejecting ink droplets to form dots on a print medium is rapidly finding its widespread use. To improve the printing speed and the resolution of printed images, this inkjet printing apparatus uses a print head that has a large number of ejection portions (also referred to nozzles) arranged in arrays, with each nozzle comprised of an ink droplet ejection opening, an ink path and a printing element or heater. There is a growing need in recent years for a capability to produce color printed images. Particularly, in producing photographic images, calls are increasing for reducing the volume of ink droplets to enhance the quality of printed images.

With a technological advance in recent years in enhancing the integration of nozzle arrays, the fabrication of a so-called elongate print head with highly dense nozzles is becoming a reality. This elongate print head can print on a print medium over an area of a greater width by its single scan than that possible with the conventional print head. This is considered a very promising technique in realizing a fast printing that has never been achieved before while maintaining as high a print quality as the conventional one. Active research is under way for further technical development. In general inkjet printing apparatus, it has been known that air currents are produced between the print head and a print medium during the printing operation.

In an inkjet printing apparatus using such an elongate print head, air currents are formed between the print head and the print medium during a printing operation, flowing around the highly dense wall of ejected ink. These wrapping air currents may in turn deflect the direction of ejected ink droplets, resulting in dot landing positions being deviated. As one method of preventing such image quality degradations, a technique is disclosed in Japanese Patent Laid-Open No. 2006-192892.

FIG. 8 shows a mask pattern used in a conventional printing apparatus. The mask pattern 100 is applicable to a so-called 2-pass printing method which completes an image in each print area by two scans complementing each other. In the conventional printing method using this mask pattern 100, the print area is divided into two areas at a predetermined interval in a nozzle-arrayed direction (direction of arrow $\alpha$ in FIG. 8). In one area, high printing ratio regions Hn are printed in a first scan of the 2-pass printing and then low printing ratio regions Ln whose print data is highly thinned are printed in a second scan. In the other area, the low printing ratio regions Ln are printed in the first scan and the high printing ratio regions Hn are printed in the second scan. With the two scans combined, a total of 100% printing ratio is achieved.

The use of the mask pattern 100, in which the thinning ratio is alternated between two levels, for example, from low to high, to low, to high and so on, forms gaps in a highly dense wall of ejected ink. More specifically, portions in the highly dense ink wall corresponding to the high thinning ratio regions in the mask pattern constitute gaps which are alternated with the dense ink wall portions corresponding to the low thinning ratio regions. These gaps allow air currents to pass through, reducing the amount of the wrapping air currents, which in turn minimizes deviations in dot landing position.

With the technique disclosed in Japanese Patent Laid-Open No. 2006-192892, large gaps need to be formed in the ink wall extending in the nozzle-arrayed direction for air currents to flow through the ink wall. In this method, the direction of scan of the print head as it prints the high printing ratio regions Hn and the low printing ratio regions Ln differs between the two areas.

Where the direction of scan, as the print head prints the high printing ratio regions and the low printing ratio regions, differ between the two areas, density unevenness may show in a printed image. For example, if the distance between a main droplet of ejected ink and a satellite, an extremely small ink droplet trailing the main droplet, differs between the forward scan direction and the backward scan direction, resulting in variations in dot-covered area ratio, there occurs a difference in the printed image density between the forward scan direction and the backward scan direction. This density difference is sometimes recognized as density unevenness.

SUMMARY OF THE INVENTION

It is therefore an object of this invention to provide an inkjet printing apparatus and an inkjet printing method that can minimize air current disturbances occurring between the print head and the print medium to reduce density unevenness that would otherwise be caused by mask patterns.

The present invention provides an inkjet printing apparatus comprising: a printing unit configured to print an image on a print medium by ejecting ink from nozzles of a print head as the print head is moved a plurality of times relative to the same print area of the print medium, wherein the print head has a first nozzle array and a second nozzle array in each of which a plurality of nozzles to eject the same color of ink are arrayed in line at a predetermined interval, wherein the first nozzle array and the second nozzle array are staggered from each other by a half of the predetermined interval in a direction in which the plurality of nozzles are arrayed; a dividing unit configured to divide image data for the same print area that are to be printed by the first nozzle array and the second nozzle array into a plurality of pieces of image data corresponding to the plurality of relative movements by using a first mask pattern for the first nozzle array and a second mask pattern for the second nozzle array; and a printing control unit configured to cause the first nozzle array and the second nozzle array to print an image in each of the plurality of movements according to the image data divided by the dividing unit; wherein the first mask pattern and the second mask pattern each have a first region with a relatively low printing ratio and a second region with a relatively high printing ratio alternated in a direction corresponding to the direction in which the nozzles are arrayed; wherein the first region of the first mask pattern and the second region of the second mask pattern are at the same position in the direction corresponding to the nozzle-arrayed direction; and wherein the second region of the first mask pattern and the first region of the second mask pattern are at the same position in the direction corresponding to the nozzle-arrayed direction.

This invention also provides an inkjet printing method comprising: a printing step to print an image on a print medium by ejecting ink from nozzles of a print head as the print head is moved a plurality of times relative to the same print area of the print medium, wherein the print head has a first nozzle array and a second nozzle array in each of which a plurality of nozzles to eject the same color of ink are arrayed in line at a predetermined interval, wherein the first nozzle array and the second nozzle array are staggered from each other by a half of the predetermined interval in a direction in which the plurality of nozzles are arrayed; a dividing step to divide image data for the same print area that are to be printed by the first nozzle array and the second nozzle array into a plurality of pieces of image data corresponding to the plurality of relative movements by using a first mask pattern for the first nozzle array and a second mask pattern for the second nozzle array; a printing control step to cause the first nozzle array and the second nozzle array to print an image in each of the plurality of movements according to the image data divided by the dividing step; a step to provide each of the first mask pattern and the second mask pattern with a first region with a relatively low printing ratio and a second region with a relatively high printing ratio, the first region and the second region being alternated in a direction corresponding to the direction in which the nozzles are arrayed; and a step to provide the first region of the first mask pattern and the second region of the second mask pattern at the same position in the direction corresponding to the nozzle-arrayed direction and to provide the second region of the first mask pattern and the first region of the second mask pattern at the same position in the direction corresponding to the nozzle-arrayed direction.

According to this invention, the inkjet printing apparatus has a means to move the print head a plurality of times relative to the same print area of the print medium. The inkjet printing apparatus also has a means to thin binary image data for the same print area by using different mask patterns that correspond to the plurality of movements over the same print area.

Further, the inkjet printing apparatus has a printing control means that completes an image on the same print area by printing thinned images on the same print area in each of the plurality of movements according to the binary image data thinned by the thinning means. The first nozzle array has alternated a plurality of nozzles that print with a relatively high printing ratio and a plurality of nozzles that print with a relatively low printing ratio. Further, spaces between those adjoining nozzles in the first nozzle array that print with a relatively high printing ratio are covered by the nozzles in the second nozzle array that print with a relatively low printing ratio. Further, spaces between those adjoining nozzles in the first nozzle array that print with a relatively low printing ratio are covered by the nozzles in the second nozzle array that print with a relatively high printing ratio.

With the above arrangement, an inkjet printing apparatus and an inkjet printing method have been realized which can minimize air current disturbances that occur between the print head and the print medium, thereby preventing density unevenness that would otherwise be caused by the mask patterns.

Further features of the present invention will become apparent from the following description of exemplary embodiments (with reference to the attached drawings).

DESCRIPTION OF THE EMBODIMENTS

Now, the first embodiment of this invention will be described by referring to the accompanying drawings.

Figure 1:
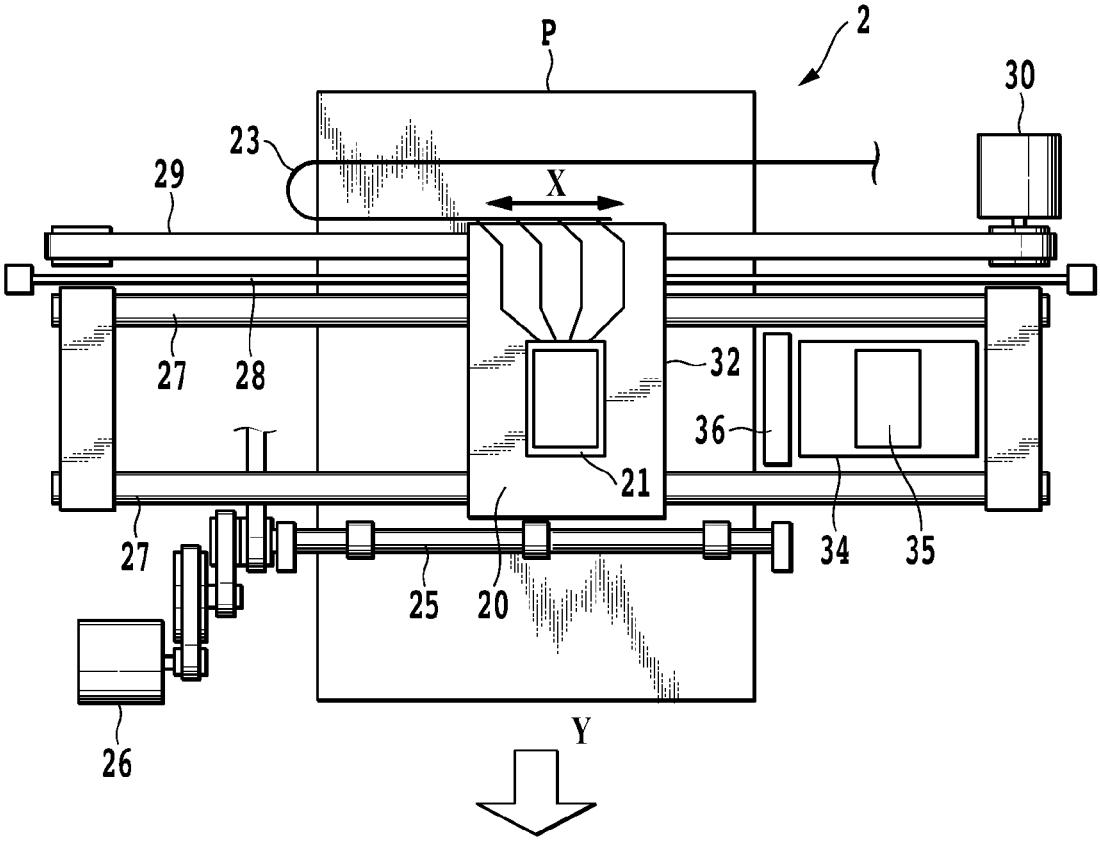
FIG. 1 is a front view showing a schematic view of an inkjet printing apparatus as one embodiment of this invention.

FIG. 1 is a front view showing an outline construction of a serial type inkjet printing apparatus capable of implementing the present invention. A carriage 32 is supported by guide shafts 27 and a linear encoder 28 so as to be reciprocally movable in a main scan direction (arrow X direction). This carriage 32 is reciprocally moved along the guide shafts 27 by operating a carriage motor 30 to drive a drive belt 29. The carriage 32 has an inkjet print head (simply referred to as a print head) 21 removably mounted therein. The print head 21 has a plurality of nozzle arrays comprising many ink ejecting portions (also referred to as nozzles). In the ink path formed in each of the nozzles of the print head 21 there is provided a heating element (or heater) that generates a thermal energy to eject ink supplied to the ink path.

The serial type inkjet printing apparatus has a medium conveying mechanism to convey a print medium P, such as plain paper, high-quality dedicated paper, OHP sheets, glossy paper, glossy films and postcards. The medium conveying mechanism has conveying rollers not shown, discharge rollers 25 and a conveying motor 26. As the conveying motor 26 is operated, the medium conveying mechanism intermittently moves the print medium in a subscan direction (arrow Y direction). The print head 21 and the medium conveying mechanism are supplied an ejection signal and a control signal from a controller unit described later through a flexible cable 23. The print head 21 and the medium conveying mechanism operate according to the ejection signal and control signal.

The heating elements in the print head 21 are energized based on a position signal of the carriage 32 output from the linear encoder 28 and on the ejection signal to generate a thermal energy to eject ink droplets from the nozzles onto the print medium. The medium conveying mechanism, according to the control signal, moves the print medium P a predetermined distance in the subscan direction during each subscan operation performed between the main scan operations of the print head 21. By repetitively moving the print head 21 and the print medium relative to each other through the printing operation by the print head 21 and the conveying operation by the medium conveying mechanism, the print medium P is progressively formed with an image over its entire surface. At a home position of the carriage 32 set outside the printing region is installed a recovery unit 34 with a cap 35 that hermetically encloses and opens ejection openings formed in the print head 21.

Figure 2:
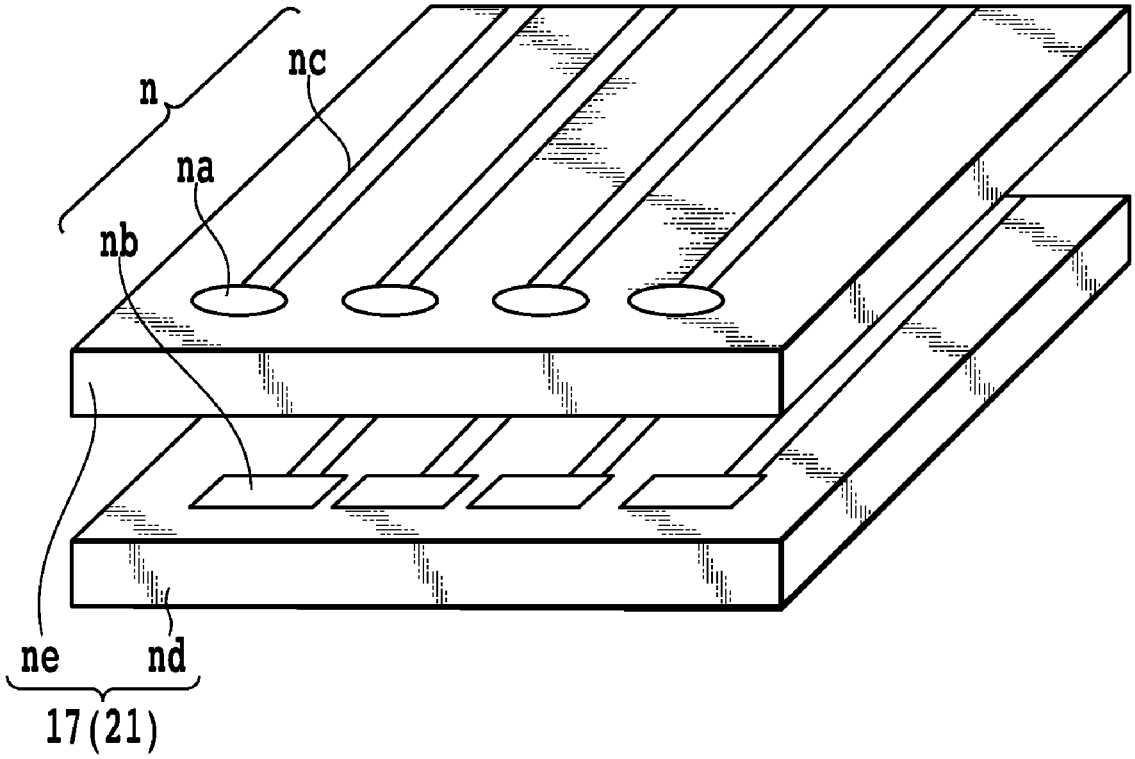
FIG. 2 is a perspective view showing a structure of nozzles of a print head.

FIG. 2 is a perspective view showing a structure of nozzles of the print head 21. The print head 21 comprises a heater board nd formed with a plurality of heaters nb to heat ink and a top plate ne put on the heater board nd. The top plate ne is formed with a plurality of nozzle openings na and, behind them, tunnellike ink paths nc communicating with the nozzle openings na. The ink paths nc are connected at their rear end to a common ink chamber, which is supplied ink through an ink supply port. Ink is supplied from the ink chamber to the individual ink paths nc.

The heater board nd and the top plate ne are bound together so that the ink paths nc match the heaters nb. While in FIG. 2 only four heaters nb are shown, the actual printing apparatus is provided with many more heaters nb, one for each ink path nc. When a predetermined drive pulse is applied to the heater nb, ink over the heater nb boils to form a bubble which, as its volume expands, causes ink in the ink path nc to be expelled as a droplet from the nozzle opening na.

As described above, each of the nozzles n has a nozzle opening na, a heater nb and an ink path nc. The inkjet printing system applicable to this invention is not limited to the one using the heating elements shown in FIG. 2. For example, in a continuous type inkjet system that continuously ejects ink droplets and forms them into desired ink particles, a charge control type and a spray control type may be applied. In an on-demand type inkjet printing system that ejects ink droplets only when demanded, a pressure control type that ejects ink droplets from nozzle openings by mechanical vibrations of a piezoelectric element may be applied.

Figure 3:
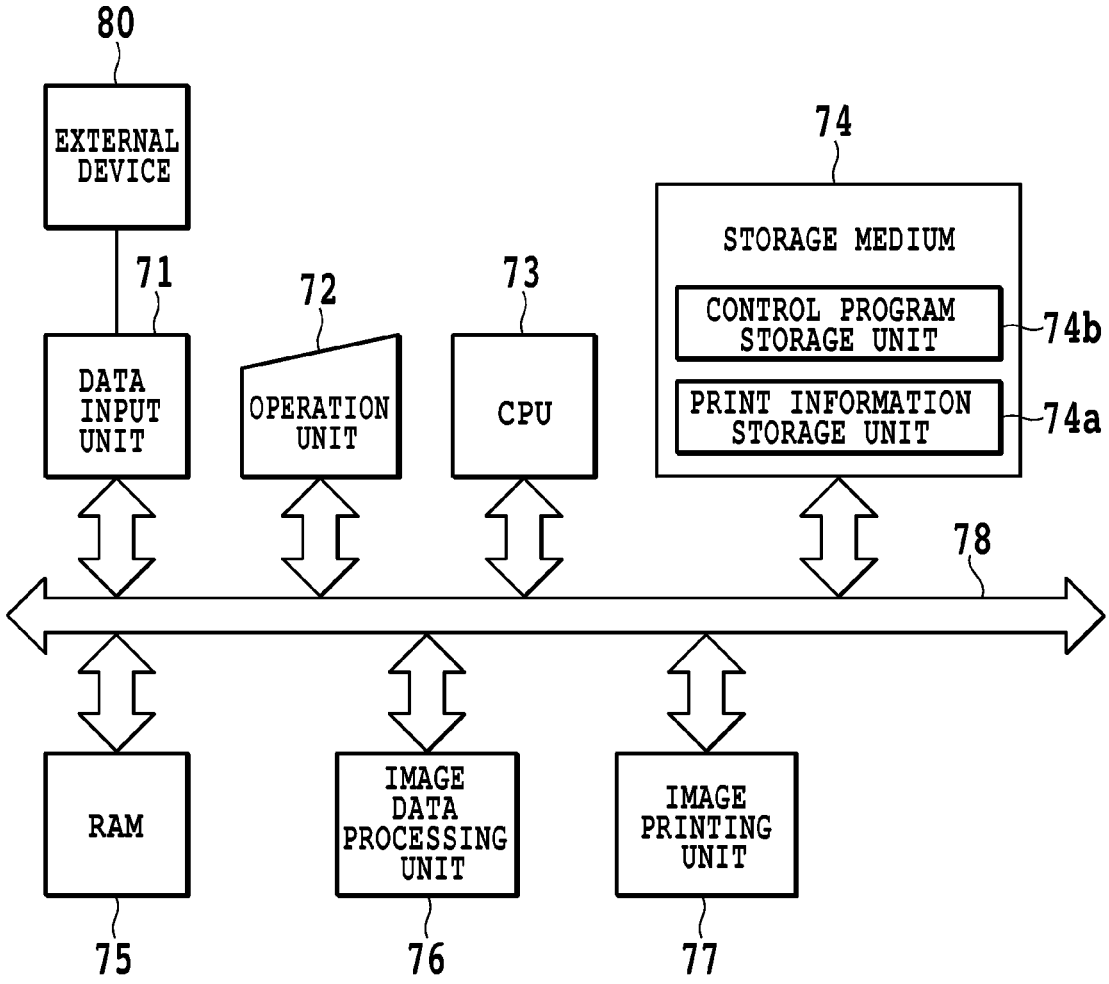
FIG. 3 is a block diagram showing one example configuration of a control system in the inkjet printing apparatus of FIG. 1.

FIG. 3 is a block diagram showing one example configuration of a control system in the inkjet printing apparatus of this embodiment. A data input unit 71 receives image data and control data sent from an external device 80 such as a host computer. An operation unit 72 is used to take in data or perform setting and operations. A CPU 73 executes various information processing and control operations (printing control). A storage medium 74 stores a variety of data and comprises a print information storage unit 74*a* and a program storage unit 74*b*. The print information storage unit 74*a* stores information related with image printing, including information on the kind of print medium P, ink, and temperature and humidity at time of printing. The program storage unit 74*b* stores various control programs.

Further, a RAM 75 temporarily stores data being processed by the CPU 73 and input data. An image data processing unit 76 performs predetermined image processing, including color conversion and binarization, on the image data received. An image printing unit 77 executes an image output by using the print head and the medium conveying mechanism. A busline 78 transmits address signals, data and control signals throughout the printing apparatus. The external device 80 may include, for example, image input devices such as scanners and digital cameras, and personal computers.

Multivalued image data output from the scanner and digital camera (e.g., 8-bit RGB data) and multivalued image data stored in a hard disk drive of a personal computer are entered into the data input unit 71. The operation unit 72 is provided with a variety of keys for setting parameters and for instructing the start of print operation. The CPU 73 controls the inkjet printing apparatus as a whole according to various programs stored in the storage medium. The programs stored in the storage medium 74 include a control program and an error processing program, according to which the entire operations of the inkjet printing apparatus of this embodiment are executed.

As the storage medium 74 to store these programs, a ROM, FD, CD-ROM, HD, memory card and magnetooptical disc may be used. The RAM 75 is used as a work area in which to execute various programs stored in the storage medium 74, as an area in which data is temporarily saved during error processing, and as a work area during image processing. Various tables in the storage medium 74 may be copied into the RAM 75, in which they may be modified and the image processing may be done referring to the modified tables. The image data processing unit 76 performs a color separation operation to convert input multivalued image data (e.g., 8-bit RGB data) into multivalued data (e.g., 8-bit CMYBk data) of each ink color for each pixel. Further, it quantizes the multivalued data of each color into K-value (e.g., 17-value) data for each pixel and sets a dot pattern for the quantized grayscale level "K" (grayscale level 0 to 16) of each pixel.

While this embodiment uses the multivalued error diffusion method for the K-value quantization operation, any other halftoning method may be used, such as an average density storing method and a dither matrix method. After the K-value quantization operation, a dot patterning operation is performed which assigns a unique dot pattern to each grayscale level for each unit area. Then, binary print data generated by the dot patterning operation is subjected to a thinning operation that distributes the print data among a plurality of printing scans of the print head by a thinning mask pattern.

The plurality of printing scans by the print head includes single printing scans by the print head having two or more nozzle arrays. By repeating the aforementioned processing, binary print data is generated which instructs each of the nozzles of the print head 21 to eject or not to eject ink. Then the image printing unit 77, based on the binary print data generated by the image data processing unit 76, forms a dot image on the print medium P.

The print head 21 of this embodiment has six blocks of ink ejecting nozzle arrays for a plurality of colors (four colors in this example) arranged in the main scan direction. A block C1 and a block C2 represent nozzle arrays of the same cyan inks; a block M1 and a block M2 represent nozzle arrays of the same magenta inks; a block Y represents yellow ink nozzle arrays; and a block Bk represents black ink nozzle arrays. In each nozzle array, 256 nozzles are arranged in line in the subscan direction at the same pitch of 1/600 inch for all colors. So, each nozzle array can print an image measuring about 10.8 mm in print width in the subscan direction.

Each of the block Bk and the block Y has two arrays of 600-dpi-pitch nozzles, with nozzle openings of the two nozzle arrays staggered a half of the pitch between adjoining nozzles in the subscan direction. The pair of nozzle arrays in the block Bk and the pair of nozzle arrays in the block Y eject ink droplets of about 5.5 pl. Each of blocks C1, C2 and blocks M1, M2 has a nozzle array to eject ink droplets of about 5.5 pl, a nozzle array to eject ink droplets of about 2.5 pl and a nozzle array to eject ink droplets of about 1.5 pl. Two nozzle arrays, one in block C1 and one in block C2, that eject the same volume of ink droplet form a pair of nozzle arrays between the different blocks, with the nozzle openings of one of the paired arrays staggered from those of the other by a half of the pitch between adjoining nozzles in the subscan direction. This same arrangement also applies to the blocks M1 and M2.

Figure 4:
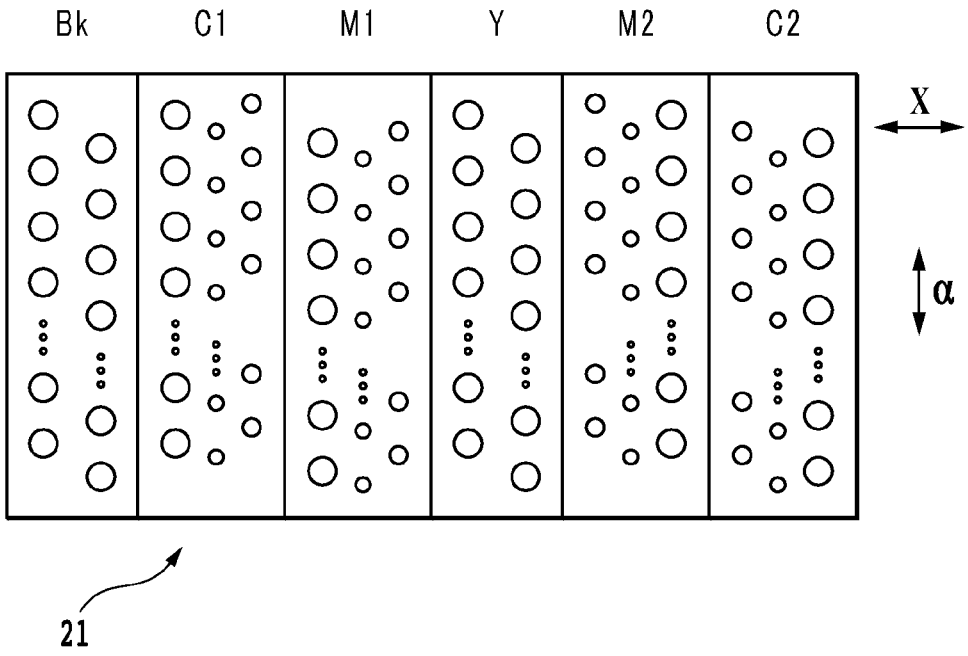
FIG. 4 is a plan view of the print head of the printing apparatus of FIG. 1 as seen from a nozzle opening face side.

This arrangement allows a space between the adjoining nozzles of the block C1 is covered by the nozzles of the block C2. The paired nozzle arrays in the blocks C1 and C2 and those in the blocks M1 and M2 are referred to as first nozzle arrays and second nozzle arrays. In FIG. 4, with the print head 21 mounted in the carriage 32, the direction of nozzles arranged in line (direction of arrow α) matches the subscan direction (Y direction) in which the print medium P is conveyed. Therefore, the direction of scan of the print head 21 is an X direction perpendicular to the subscan direction.

Next, an example of a divide-by-thinning printing, a characteristic aspect of this invention, will be explained. In this embodiment, the print data is thinned by a mask pattern, which has low printing ratio regions (high thinning ratio regions) of a predetermined width and high printing ratio regions (low thinning ratio regions) of a predetermined width, to distribute the print data to individual nozzles of the print head. This is one of characteristic constructions of this embodiment.

Figure 5A:
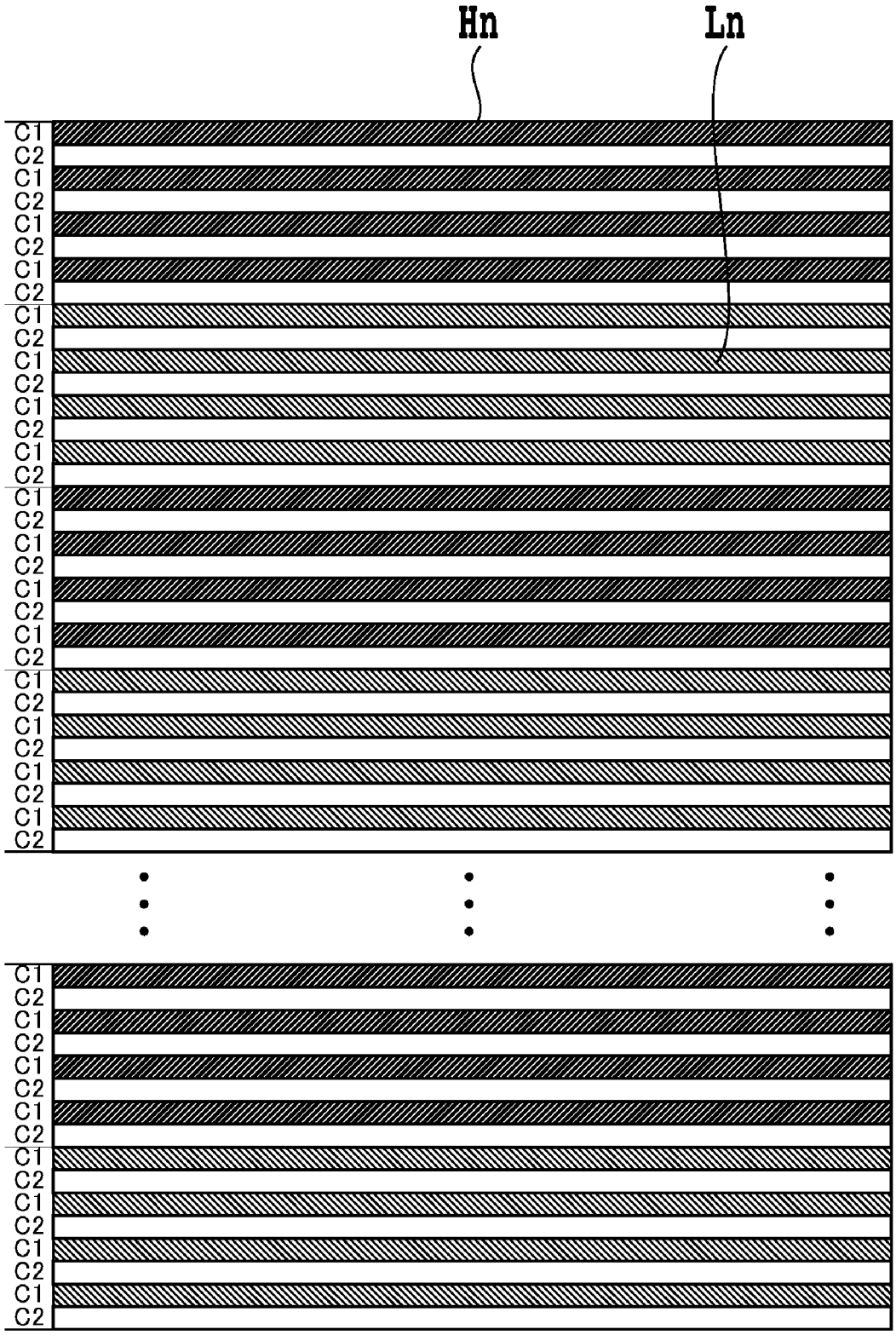
FIG. 5A is a plan view conceptually showing a part of a mask pattern in one embodiment of this invention.
Figure 5B:
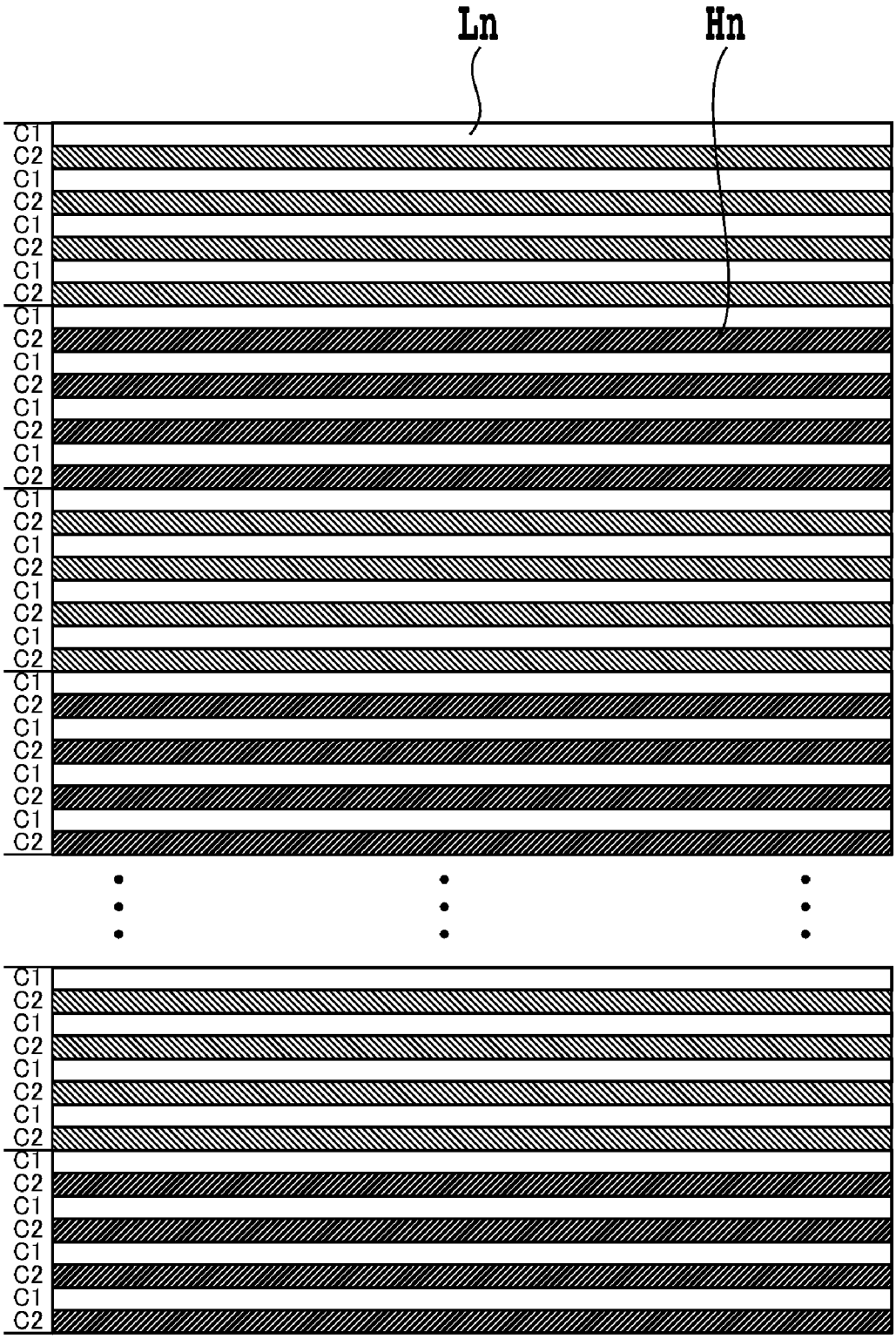
FIG. 5B is a plan view conceptually showing a part of a mask pattern in the embodiment.
Figure 5C:
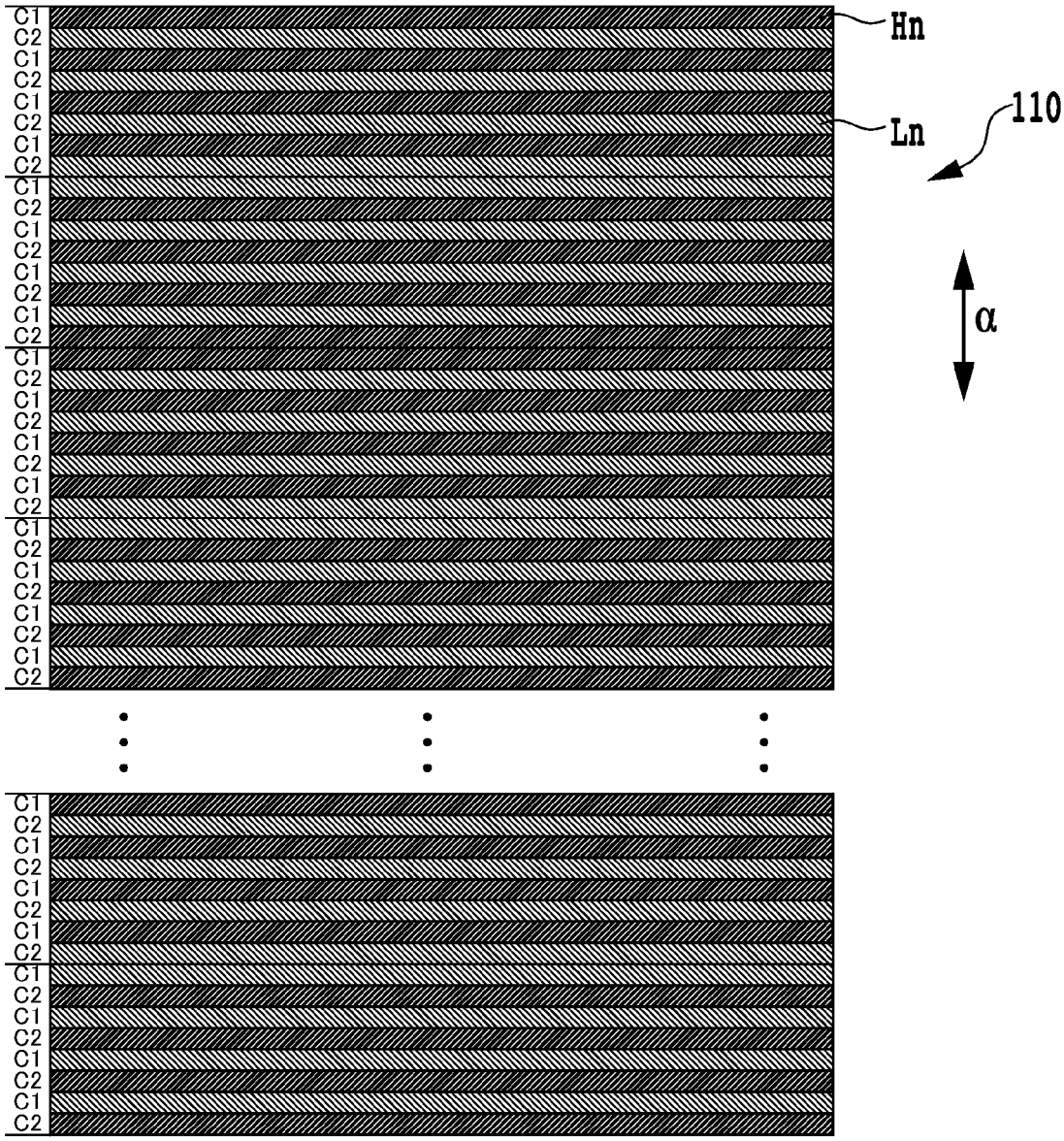
FIG. 5C is a plan view conceptually showing a part of a mask pattern in the embodiment.

FIG. 5A to FIG. 5C are conceptual diagrams showing a part of a mask pattern 110 in this embodiment. The mask pattern 110 is an example mask applied to a so-called 2-pass printing and which divides the print data to be printed on the same print area of the print medium into two printing scans. The 2-pass printing is a method of printing which executes a plurality of relative movements between the print head and the print medium (in this embodiment, two relative movements or two passes) so that the two printing passes complement each other to complete an image on each print area. The mask pattern 110 includes high printing ratio regions Hn with a printing ratio in excess of 50% and low printing ratio regions Ln with a printing ratio below 50%. FIG. 5A shows a first mask pattern applied to the first nozzle array (for a portion shown at C1 only) and FIG. 5B shows a second mask pattern applied to the second nozzle array (for a portion shown at C2 only).

FIG. 5C shows a mask pattern combining those of FIG. 5A and FIG. 5B. The low printing ratio regions (high thinning ratio regions) Ln as a first masking region are regions that thin the print data binarized by the image data processing unit 76 at a high thinning ratio. The high printing ratio regions (low thinning ratio regions) Hn as a second masking region is regions that thin the binary print data at a low thinning ratio. In this embodiment, the high printing ratio regions Hn are set at the printing ratio of 65% and the low printing ratio regions Ln at 35%. The printing ratio means a percentage of pixels permitted to be printed with respect to all pixels in a given area. Whether a dot is actually printed in a particular pixel depends on the print data for that pixel.

As shown in FIG. 5A, the first nozzle array C1 has its nozzles arranged as follows. Counting from the top nozzle downward, four consecutive nozzles constitute a group of high printing ratio regions, the next four nozzles constitute a group of low printing ratio regions, the next four nozzles constitute a group of high printing ratio regions and so on. The group of high printing ratio regions and the group of low printing ratio regions are alternated every four nozzles. On the other hand, in the second nozzle array C2 as shown in FIG. 5B, its top four consecutive nozzles constitute a group of low printing ratio regions and the next four nozzles a group of high printing ratio regions. The second nozzle array C2 has a group of high printing ratio regions and a group of low printing ratio regions alternated every four nozzles in an order reverse to that of the first nozzle array. With this arrangement, in both the first nozzle array and the second nozzle array, a plurality of low printing ratio regions are provided that form passages, each four nozzles wide in the nozzle array direction, through which air currents can flow, preventing dot landing position deviations that would otherwise be caused by the wrapping air currents.

An image on the print medium is completed by the combination of operations of the first nozzle arrays and the second nozzle arrays. As shown in FIG. 5C, the combined mask pattern has the high printing ratio regions and the low printing ratio regions alternated in the nozzle array direction every predetermined print width as narrow as one pixel. With this arrangement, since the print data is distributed into two areas on the print medium that are alternated every pixel in the subscan direction—one that is printed as a high printing ratio region in the first pass and as a low printing ratio region in the second pass and one that is printed as a low printing ratio region in the first pass and as a high printing ratio region in the second pass—density unevenness can be scattered and made hardly noticeable.

The printing method of this embodiment completes an image by printing each print area with two scans complementing each other. In a first scan, the printing operation is done by using the mask pattern 110 of FIG. 5C. Next, the print medium is conveyed a half the length of the nozzle arrays of the print head 21, after which a second scan is executed using an inverted pattern (not shown) of the mask pattern 110. Then, the print medium is conveyed the same distance as in the previous medium conveying operation, followed by the first scan being executed again using the mask pattern 110. The first scan and the second scan are alternately repeated until an image on the print medium is completed. With this mask pattern 110, even if the print head with nozzle arrays of dense nozzles, such as shown in FIG. 4, is scanned at high speed for printing, good ink droplet ejection state can be realized, thus forming an image with few dot landing errors.

Here, the reason (mechanism) that the above-described dot landing position deviations are reduced by the mask pattern that has a high thinning ratio region and a low thinning ratio region alternated, will be explained. In the serial type and the full line type inkjet printing apparatus, to complete an image in a short period of time requires performing high-speed relative scans at high printing ratios. During this printing operation it has already been described that air current disturbances occur between the print head and the print medium. The amount of air currents formed and the degree to which the air currents are disturbed greatly depend on the scan speed and the printing ratio. They also depend greatly on a thinning ratio distribution in the mask pattern.

If a mask pattern is used that has its thinning ratios distributed in the nozzle array direction in an alternate high-low thinning ratio pattern, gaps are formed in a highly dense ejected ink wall. More precisely, at portions in the ejected ink wall corresponding to the high thinning ratio regions in the mask pattern, there are formed gaps, which are alternated by the low thinning ratio region or ink wall in the nozzle array direction. Through these gaps air currents pass, reducing the volume of wrapping air currents, with the result that the dot landing position deviations that would otherwise be caused by the wrapping air currents can also be restrained.

For the air currents to pass through the ejected ink wall extending in the nozzle array direction, sufficiently large gaps need to be formed. In the conventional method, therefore, the high thinning ratio regions are required to have a substantially large width, which may sometimes become large enough that a high-low density pattern in one scan is visible. This can be explained as follows. Since each print area is completed by a plurality of scans that complement each other, if there is any element that causes the printed density to differ from one scan to another, density unevenness tracing the mask pattern shows in the printed image.

Here, how density unevenness in the printed image occurs will be explained. An ink droplet, after being ejected from a nozzle opening in the form of an elongate column of ink, splits while flying, with a front portion of the ink column forming into a main droplet and a trailing portion forming into satellites, both landing on a print medium. The positional relation on the print medium between the main droplet and the satellites varies depending on the flying speeds of the droplets, a gap between the print head and the print medium and an angle at which the ink droplet is ejected from the nozzle opening.

Figure 6:
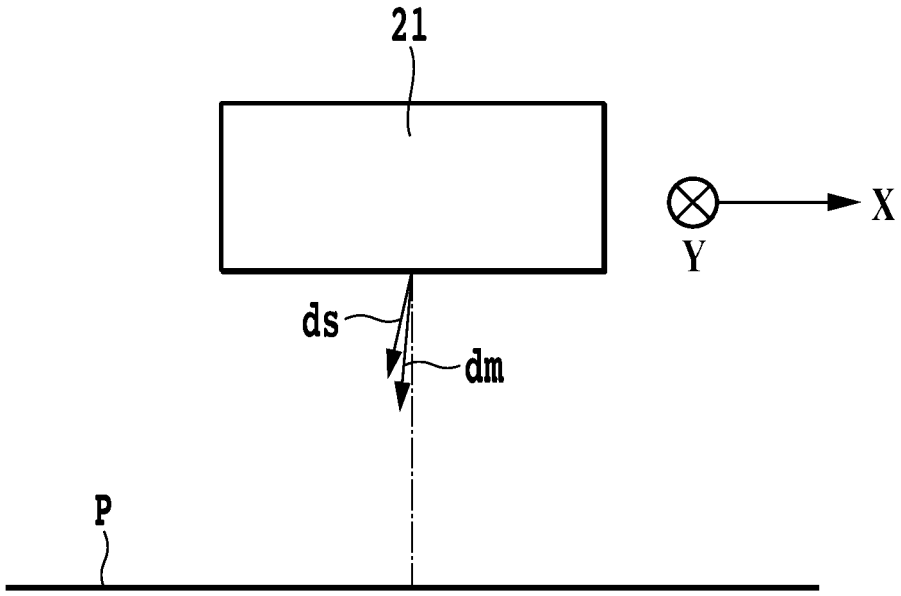
FIG. 6 shows directions in which ejected ink droplets fly from the print head toward a print medium.

FIG. 6 shows in which directions the ink droplets ejected from the print head 21 fly toward the print medium. If an ejection direction dm of the main droplet from the print head 21 and an ejection direction ds of the satellite have shift components in the carriage scan direction X, the positions on the print medium P at which the main droplet and the satellite land when the print head moves in the forward direction differ greatly from those when it moves in the backward direction.

Figure 7A:
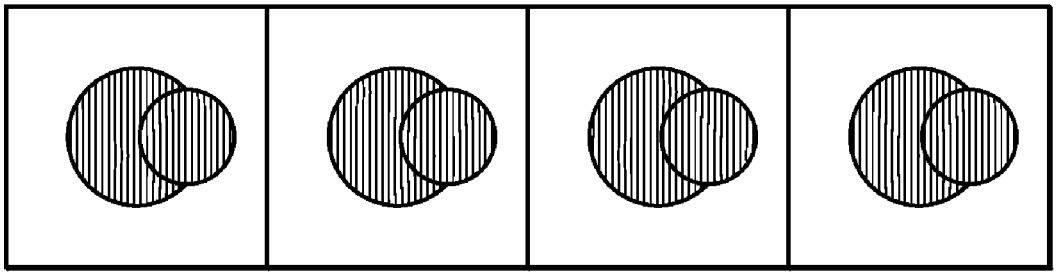
FIG. 7A is a plan view schematically showing a positional relation between a main droplet and a satellite droplet.
Figure 7B:
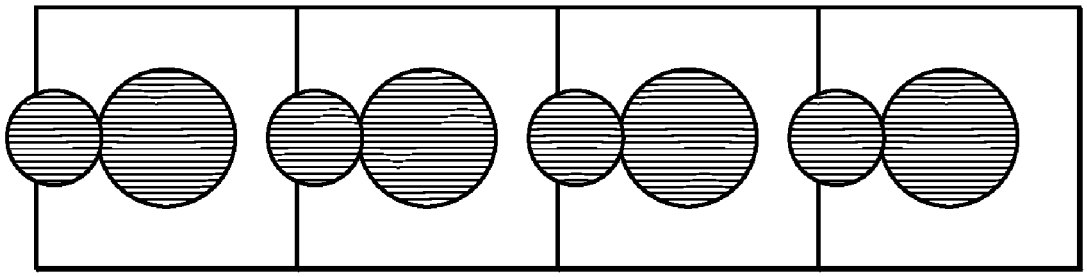
FIG. 7B is a plan view schematically showing a positional relation between a main droplet and a satellite droplet.
Figure 8:
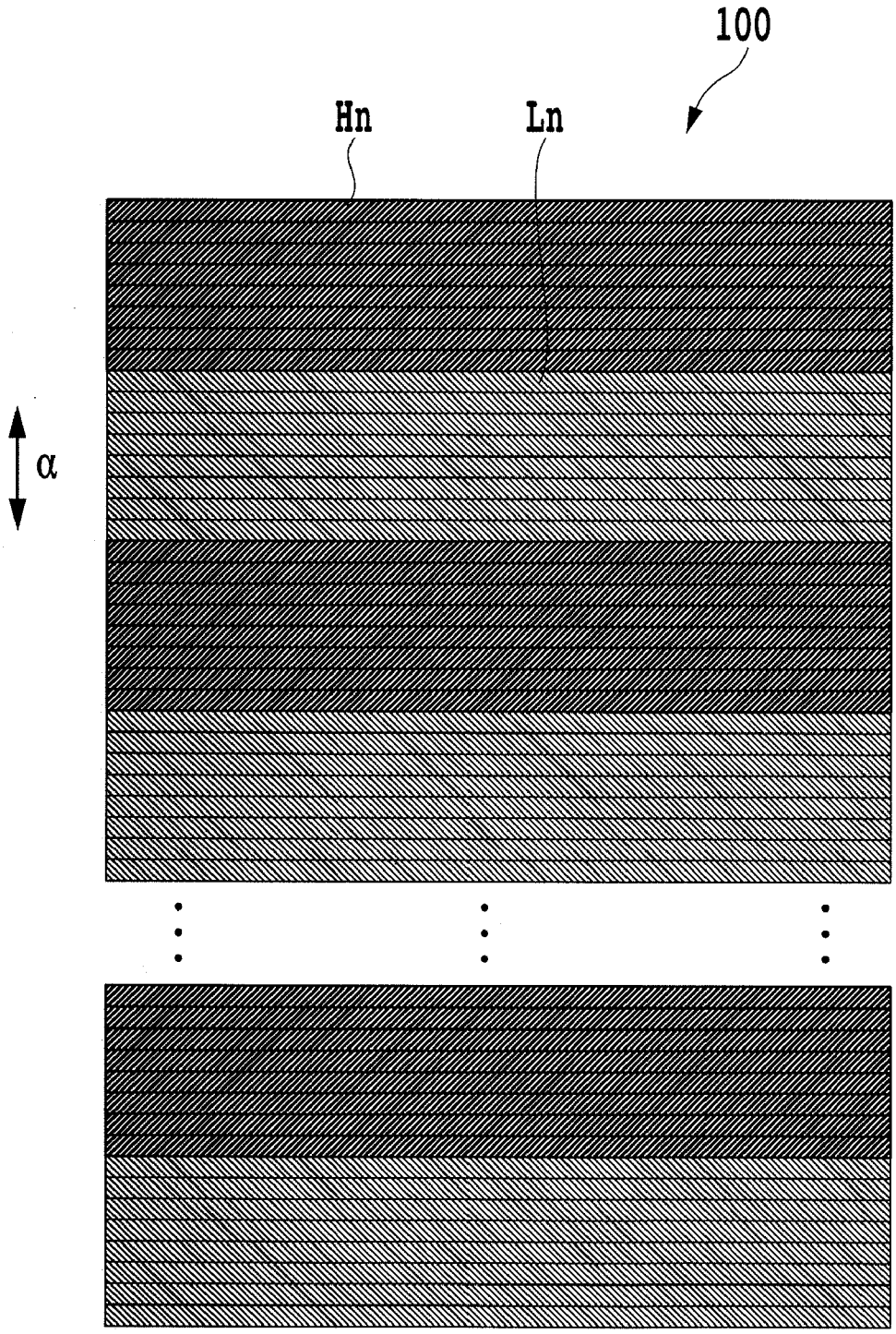
FIG.8 PRIOR ART
FIG. 8 shows a mask pattern used in a conventional printing apparatus.

FIG. 7A and FIG. 7B are plan views schematically showing a positional relation between main droplets and satellites that have landed on the print medium within pixels. FIG. 7A represents the landing positions of the droplets when the carriage is moving in the forward direction (X direction) of FIG. 6. FIG. 7B represents their landing positions when the carriage is moving in the backward direction. As can be seen from the comparison between FIG. 7A and FIG. 7B, a dot-covered area ratio in one pixel is smaller when dots are formed during the forward printing than during the backward printing, which means that the image printed by the forward printing looks lighter in density. If, in such a printing condition, pixels should be large enough that the dot-covered area is distinguishable to human eye, the printed image would show density unevenness.

In this embodiment, therefore, an image area printed by both the first nozzle array and the second nozzle array is printed using the mask pattern whose thinning ratio changes every pixel in the nozzle array direction (direction of arrow $\alpha$), as shown in FIG. 5C. So, the spatial frequency at which the thinning ratio is repetitively switched between a high level and a low level in one scan is maximum. Thus, even if there are variation elements, such as dot-covered area ratio and ink ejection volume, that may vary among different scans, since these variation elements are distributed over the image at a resolution undistinguishable to human eye, they cannot be recognized as density unevenness in a printed result.

As described above, in a 2-pass printing, this embodiment performs the printing operation such that the high printing ratio region and the low printing ratio region are alternated every pixel in the nozzle array direction and that adjoining groups of high printing ratio regions are separated from one another by a group of low printing ratio regions that forms a passage wide enough for air currents to pass through. With this arrangement, an inkjet printing apparatus and an inkjet printing method have been realized which can prevent air currents between the print head and the print medium from being disturbed, which in turn helps prevent density unevenness that may be caused by the mask pattern.

In the above explanation, the mask patterns applied to the nozzle arrays C1 and C2 have a group of high printing ratio regions and a group of low printing ratio regions alternated at equal intervals of four nozzles. The alternating cycle between the high printing ratio regions and the low printing ratio regions may be random. For example, in the first nozzle column C1, the upper four nozzles may be used as high printing ratio regions, the next two nozzles immediately below the first four as low printing ratio regions and the next three nozzles as high printing ratio regions, with the alternating interval between the high printing ratio regions and the low printing ratio regions randomly changing. In that case, the mask for the second nozzle array C2 is in an inverted relationship with the mask for the first nozzle array C1, with the top four nozzles used as the low printing ratio regions, the next two nozzles as the high printing ratio regions and the next three nozzles as the low printing ratio regions.

The present invention is not just applicable to 2-pass printing but also to other printing methods using a greater number of passes. Whatever the number of passes, this invention can achieve its object of alleviating density unevenness that is caused by the fact that the combinations of high printing ratio regions and low printing ratio regions in the direction of scan differs from one print area to another. It is noted, however, that the density unevenness is likely to occur in the printing methods with a small number of passes, like a 2-pass printing. This invention is particularly useful for such printing methods with a small number of passes.

Further, the printing ratios of the high printing ratio regions and of the low printing ratio regions may be changed between the first nozzle array and the second nozzle array. For example, the first nozzle array may be given a printing ratio of 65% for the high printing ratio regions and a printing ratio of 35% for the low printing ratio regions, and the second nozzle array may be given 70% for the high printing ratio regions and 30% for the low printing ratio regions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-150075, filed Jun. 24, 2009, which is hereby incorporated by reference herein in its entirety.

What is claimed is:

1. An inkjet printing apparatus comprising:

a printing unit configured to print an image on a print medium by ejecting ink from nozzles of a print head as the print head is moved a plurality of times relative to the same print area of the print medium, wherein the print head has a first nozzle array and a second nozzle array in each of which a plurality of nozzles to eject the same color of ink are arrayed in line at a predetermined interval, wherein the first nozzle array and the second nozzle array are staggered from each other by a half of the predetermined interval in a direction in which the plurality of nozzles are arrayed;

a dividing unit configured to divide image data for the same print area to be printed by the first nozzle array and the second nozzle array into a plurality of pieces of image data corresponding to the plurality of relative movements by using a first mask pattern for the first nozzle array and a second mask pattern for the second nozzle array; and a printing control unit configured to cause the first nozzle array and the second nozzle array to print an image in each of the plurality of movements according to the image data divided by the dividing unit, wherein the first mask pattern and the second mask pattern each have a first region with a relatively low printing ratio and a second region with a relatively high printing ratio alternated in a direction corresponding to the direction in which the nozzles are arrayed, wherein the first region of the first mask pattern and the second region of the second mask pattern are at the same position in the direction corresponding to the nozzle-arrayed direction, and wherein the second region of the first mask pattern and the first region of the second mask pattern are at the same position in the direction corresponding to the nozzle-arrayed direction.

2. An inkjet printing apparatus according to claim 1, wherein in the first mask pattern and the second mask pattern, the first region and the second region are equal in length.

3. An inkjet printing apparatus according to claim 1, wherein in the first mask pattern and the second mask pattern, the first region and the second region are random in length.

4. An inkjet printing apparatus according to claim 1, wherein the printing ratio of the first region of the first mask pattern is equal to the printing ratio of the first region of the second mask pattern, and wherein the printing ratio of the second region of the first mask pattern is equal to the printing ratio of the second region of the second mask pattern.

5. An inkjet printing apparatus according to claim 1, wherein an image is completed by performing two movements of the print head relative to the same print area of the print medium.

6. An inkjet printing method comprising:

a printing step to print an image on a print medium by ejecting ink from nozzles of a print head as the print head is moved a plurality of times relative to the same print area of the print medium, wherein the print head has a first nozzle array and a second nozzle array in each of which a plurality of nozzles to eject the same color of ink are arrayed in line at a predetermined interval, wherein the first nozzle array and the second nozzle array are staggered from each other by a half of the predetermined interval in a direction in which the plurality of nozzles are arrayed;

a dividing step to divide image data for the same print area to be printed by the first nozzle array and the second nozzle array into a plurality of pieces of image data corresponding to the plurality of relative movements by using a first mask pattern for the first nozzle array and a second mask pattern for the second nozzle array;

a printing control step to cause the first nozzle array and the second nozzle array to print an image in each of the plurality of movements according to the image data divided by the dividing step;

a step to provide each of the first mask pattern and the second mask pattern with a first region with a relatively low printing ratio and a second region with a relatively high printing ratio, the first region and the second region being alternated in a direction corresponding to the direction in which the nozzles are arrayed; and a step to provide the first region of the first mask pattern and the second region of the second mask pattern at the same position in the direction corresponding to the nozzle-arrayed direction and to provide the second region of the first mask pattern and the first region of the second mask pattern at the same position in the direction corresponding to the nozzle-arrayed direction.

* * * * *